United States Patent [19]

White

[11] Patent Number: 4,708,415

[45] Date of Patent: Nov. 24, 1987

[54] ELECTRICAL CONNECTORS

[75] Inventor: Rowland S. White, Hampshire, England

[73] Assignee: Amphenol Corporation, Wallingford, Conn.

[21] Appl. No.: 855,272

[22] Filed: Apr. 24, 1986

[30] Foreign Application Priority Data

Apr. 29, 1985 [GB] United Kingdom ..... 8510840

[51] Int. Cl.[4] ..... H01R 9/09

[52] U.S. Cl. ..... 439/633; 439/59

[58] Field of Search ..... 339/17 LC, 176 MP, 220, 339/221

[56] References Cited

U.S. PATENT DOCUMENTS

| | | | |
|---|---|---|---|
| 3,526,869 | 9/1970 | Conrad et al. | 339/176 MP X |
| 3,530,442 | 9/1970 | Goodman | 339/176 MP X |
| 3,926,496 | 12/1975 | Occhipinti | 339/176 MP X |
| 4,232,923 | 11/1980 | Otsuki et al. | 339/17 LC |
| 4,392,705 | 7/1983 | Andrews, Jr. et al. | 339/17 LC X |
| 4,425,015 | 1/1984 | Rizzo | 339/17 LC |

FOREIGN PATENT DOCUMENTS

| | | | |
|---|---|---|---|
| 72122 | 2/1983 | European Pat. Off. | 339/176 MP |
| 2333273 | 1/1974 | Fed. Rep. of Germany | 339/176 MP |
| 8402475 | 11/1980 | PCT Int'l Appl. | 339/176 MP |
| 8403396 | 8/1984 | PCT Int'l Appl. | 339/176 MP |
| 1313641 | 4/1973 | United Kingdom | 339/176 MP |
| 1374671 | 11/1974 | United Kingdom | 339/176 MP |
| 1393771 | 5/1975 | United Kingdom | 339/176 MP |
| 1446296 | 8/1976 | United Kingdom | 339/176 MP |
| 1452659 | 11/1976 | United Kingdom | 339/176 MP |
| 1490041 | 11/1977 | United Kingdom | 339/176 MP |
| 2162380 | 1/1986 | United Kingdom | 339/176 MP |

*Primary Examiner*—Gil Weidenfeld
*Assistant Examiner*—Glenn L. Webb
*Attorney, Agent, or Firm*—Bacon & Thomas

[57] ABSTRACT

An edge mounted multicontact printed circuit board connector having a body (3) grooved to receive the edge of a cutaway (2) of a printed circuit board (1), the body carrying spaced strip-like resilient contact elements (4) having outward portions (6) which engage respective surface contacts (7) of the circuit board and inward portions (12) which are curved to extend into a cavity (20) of the body for resilient engagement with contacts (11) of a male cable connector (10) when inserted therein.

9 Claims, 4 Drawing Figures

ELECTRICAL CONNECTORS

BACKGROUND OF THE INVENTION

Field of the Invention

This invention relates to electrical connectors and relates more especially to multicontact connectors for printed circuit boards.

Electrical connectors presently used for making connection to printed circuit boards have hitherto typically consisted of resilient metal contacts mounted in racks arranged to receive the circuit boards and to cooperate with surface contacts of the boards when pressed into their operating positions. Alternatively, surface mounted connectors have been provided for attachment to circuit boards to receive male multi-pin plug-in cable connectors.

Hitherto with integrated elements on a printed circuit board electrical connections to such a board have occupied an appreciable part of the space occupied by the board itself and the present invention seeks to provide an improved and/or more compact electrical connector for this purpose.

In addition, when some conventional connectors are mated to a circuit board, the force imposed during mating deforms the board or the connector, which can fracture the connections. It would be desirable to eliminate this problem also.

SUMMARY OF THE INVENTION

According to the present invention, there is provided a multi-contact electrical connector for making connections to a circuit member comprising a first body housing a plurality of side by side strip-like contact elements outward portions of which bear against respective surface contacts of the circuit member and curved inward portions of which are engageable with respective contacts of a mating connector when inserted into a cavity of the body shaped to receive it.

Preferably, the strip-like contact elements comprise curved leaf-spring elements with configurations the inward portions of which are retained within spaced slots formed in the body, positioning them for registration with surface contacts of the mating connector.

DESCRIPTION OF THE PREFERRED EMBODIMENTS

Figure 1:
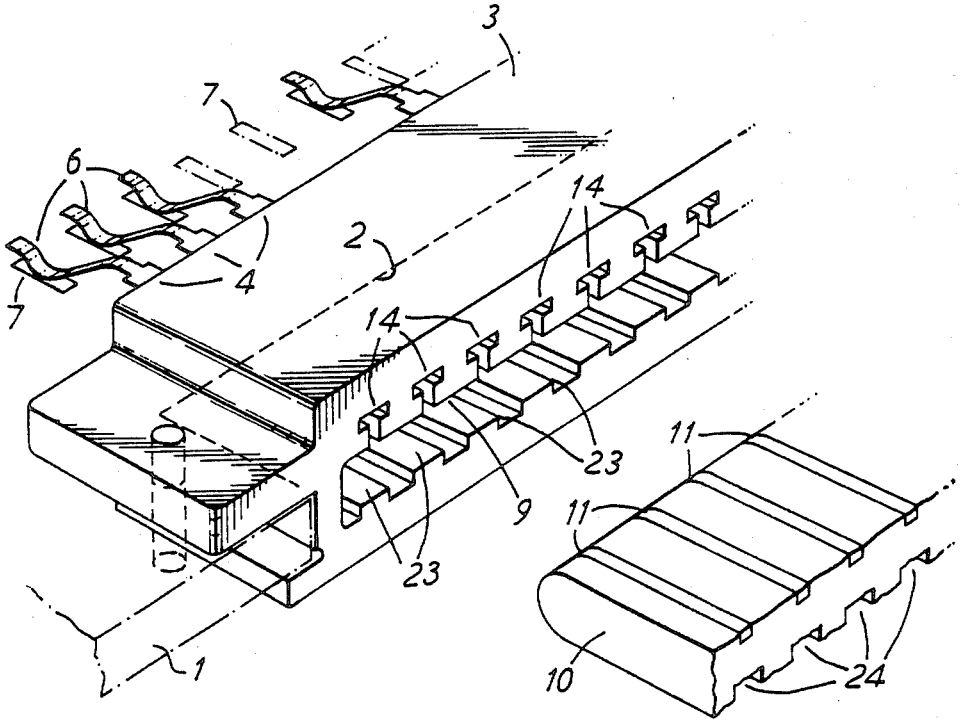
FIG. 1 shows on an enlarged scale a general perspective view of an edge-mounted electrical printed circuit board connector in accordance with one embodiment of the invention.

Referring to FIG. 1, a straight edge of a circuit member comprising a printed circuit board 1 has a cut-away (shown by broken outline) 2, fitted to it an elongated molded plastic body member denoted by reference 3. Body member 3 accommodates spaced springy strip-like conducting contact elements 4 the outward portions 6 of which are curved to make resilient contact with equally spaced side by side surface contacts 7 of printed circuit board 1.

In order to achieve positive location of body 3 and registration of the portions 6 with respective contacts 7 of the circuit board, body 3 is provided on its back face and its ends with a groove 5 (more clearly seen in FIGS. 3 and 4) which accepts the longitudinal edge and ends of cut-away 2 which extends parallel to the edge of the circuit board, body 3 being fixed to the board by means of a through bolt or rivet through a flange 8 at each end thereof. The groove 5 has a part 5*a* which engages the face of the body opposite that which covers contacts 7 and acts to resist relative warping between body 3 and board 1. Body 3 is provided at its front face with a mouth 9 of a cavity 20 for accepting a multi-contact male connector represented by the reference 10 having parallel strip-like contacts 11 which register with inner portions 12 of the springy contact elements (which as will be seen project into cavity 20 which receives connector 10). Male connector 10 has its respective strip contacts 11 internally connected to solderable or insulation displacement contact (IDC) wire core connections (not shown) in a conventional manner.

Figure 2:
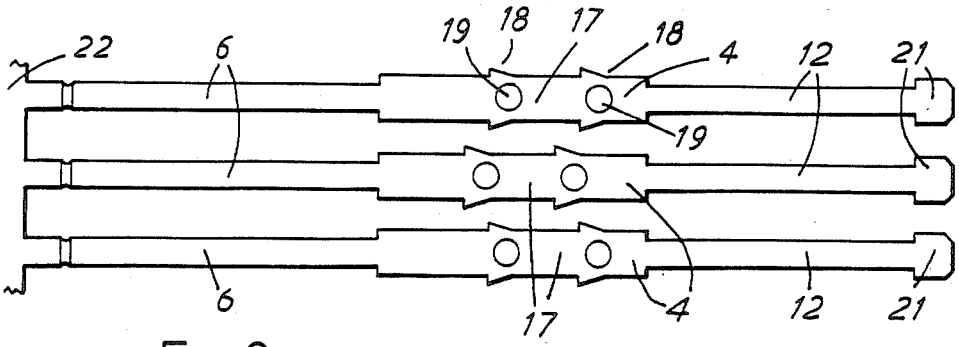
FIG. 2 shows on a larger scale a plan view of three leaf-spring contact elements for use in a connector such as shown in FIG. 1.
Figure 3:
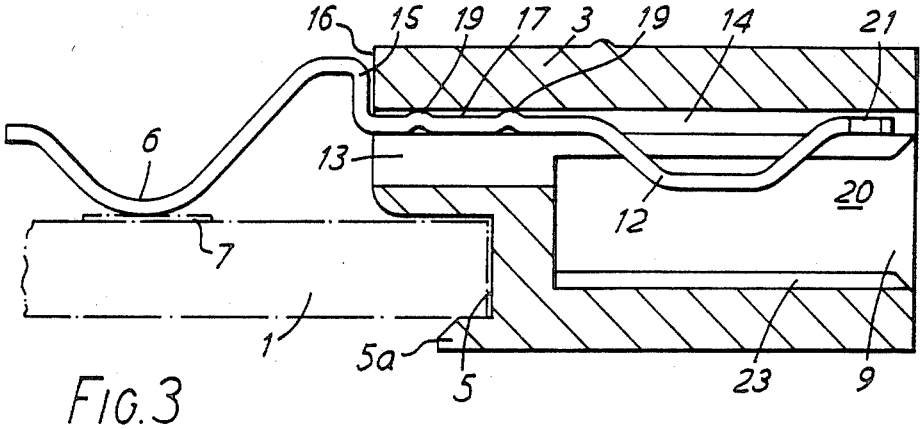
FIG. 3 shows in the same scale a section through the connector and a leaf-spring contact element located therein.
Figure 4:
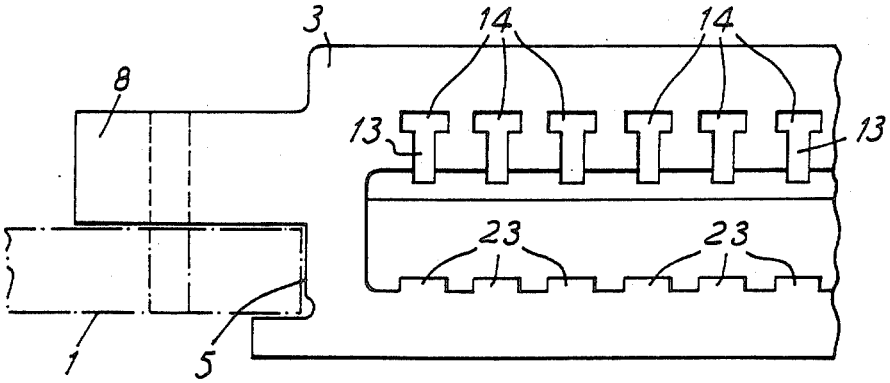
FIG. 4 shows on the same scale an edgewise view of part of the body of the connector.

Referring now to FIGS. 2, 3 and 4, molded body 3 is provided with a plurality of through-slots 14 extending parallel to the plane of circuit board 1, designed to respectively accept the widths of the contact elements 4. Each of these slots has a downwardly extending narrower center portion 13 wide enough to accept and slidingly receive a narrower portion 12 of a respective element 4, the shape of which in plan view of three of such contacts is clearly discernable from FIG. 2. As seen from FIG. 3, elements 4 are each of complex curved configuration providing at the left-hand end the resilient downward urged curved portion 6 engageable with a respective surface contact 7 shown here on the dotted outline of circuit board 1. An adjacent part 15 is abuttable with the back face 16 of body 3, part 15 being a part of a wider portion 17 carrying identations 19 and lateral barbs 18 for effecting interference fit in the above-mentioned slots 14, and narrower inward parts 12 project via a slot portion 13 into rectangular cavity 20 of the body accessible to connector 10 via mouth 9. Finally, a wider innermost end 21 of element 4 is shaped to be slidingly located in the respective slot 14.

For the purposes of easily assembling the connector, the requisite number of resultant springy connector strips 4 are provided in the form of a stamping from sheet conductor material which is left, as shown for the three contacts of FIG. 2, with portion 6 conjoined at an edge portion 22. All contact elements 4 for a multicontact connector can, therefore, be assembled in one operation to connector body 3 by being pressed into position through the respective slots 14 until the respective portions 15 abut inner face 16 of body 3. Indentations 19 and barbs 18 respectively provide positive interference fit and positioning and non-return location of strips 4 in the body. Body 3 is then mountable to the edge of circuit board 1 whereby the outward portions 6 of the contact elements make resilient contact with the respective surface contacts 7 of the board and may subsequently be soldered if required. Edge portion 22 is removed after insertion to separate the contacts.

A male connector such as cable connector 10 is then insertable at mouth 9. Registration of the contacts of connector 10 with respective inward portions 12 of contact elements 4 is precisely achieved by having, as shown in FIG. 1, molded-in underside grooves 24 to provide sliding fit and registration with internal ribs 23 of circuit board connector 3 as seen in FIGS. 1, 3 and 4. Narrower portions 12 of contact elements 3 are thereby resiliently deflectable upwards as seen in FIG. 3, the respective wider end portions 21 being slideably retained in slot 14 allowing for such deflection, whereas portions 12 are positively positioned against movement out of lateral registration by the sides of slot portions 13.

A multicontact electrical connector in accordance with the present invention is seen to be easily assembled with relatively few assembly operations. Since, moreover, it can provide for edgewise connection to a male cable connector it offers the possibility of a compact printed circuit board assembly affording each printed circuit board in a complete apparatus the possibility of requiring less height than a board having a surface mounted connector. The header (or female) connector is designed to project above the surface of the board by an amount which is comparable to that of surface mounted electronic components.

In addition, the header connector transfers mating forces directly in line with the circuit board, minimizing stress on the solder joints and hence their likelihood of failure.

Also, the connector can be used either as an input-output or a board-to-board connector.

I claim:

1. A multi-contact electrical connector for making connection to an edge of a printed circuit board having a plurality of surface contacts on a first surface thereof, said connector comprising a housing having a first end adapted to receive a mating connector having electrical contacts and a second end adapted to receive said edge of said circuit board, said first end having a forward face and said second end having a back face, a plurality of contact receiving cavities in said housing, each of said cavities comprising a first slot extending in an inner wall of said housing and a second slot connected to said first slot and arranged substantially perpendicular to the plane of said first slot, both said first and second slots extending from said forward face of said first end of said housing to said back face of said second end of said housing, a connector receiving cavity extending inwardly from said forward face to receive said mating connector, a plurality of side-by-side spaced strip-like resilient contact elements received in said housing with respective elements being received in respect ones of said contact receiving cavities, each of said contact elements having an innermost end, an inner portion connected to and being narrower than said innermost end, an intermediate portion connected to and being wider than said inner portion, and an outer portion connected to said intermediate portion and adapted to bear against respective ones of said surface contacts of said circuit board, said contact elements being mounted in said contact receiving cavities such that said innermost end is slidingly located in said first slot adjacent to said forward face of said housing, said inner portion being slidingly acceptable in said second slot and extending downwardly from said innermost end, said inner portion having a substantially U-shape and extending into said connector receiving cavity and engageable with said contacts of said mating connector, said intermediate portion of said contact element being received in said first slot, retaining means on said intermediate portion to retain said contact element in its respective contact receiving cavity, a part of said intermediate portion extending outwardly of said housing and being in abutment with said back face of said housing, and said outward portion of said contact element extending downwardly from said part of said intermediate portion and having a substantially U-shape for engagement with a respective one of said surface contacts of said circuit board.

2. The connector of claim 1, wherein said housing includes a flange extending in a direction laterally away from said connector receiving cavity and adapted for mounting said connector to said circuit board.

3. The connector of claim 2, wherein said retaining means on said intermediate portion of said contact element comprises indentations and lateral barbs.

4. The connector of claim 3, wherein said housing includes a plurality of ribs in said connector receiving cavity for registration with a plurality of grooves in said mating connector.

5. The connector of claim 4, wherein said body includes a part located at said second end for engagement with a surface of said board opposite to said first surface.

6. A printed circuit board assembly comprising a multi-contact electrical connector as claimed in claim 1, edge mounted to a printed circuit board.

7. The assembly of claim 6, wherein said board is provided with a cutaway in said edge of said board, said connector being mounted in said cutaway in said edge.

8. The assembly of claim 7, wherein said housing includes a flange extending in a direction laterally away from said connector receiving cavity and adapted to be mounted to a portion of said board adjacent to said cutaway.

9. The assembly of claim 8 wherein said body includes a part located at said second end for engagement with a surface of said board opposite to said first surface.

* * * * *